US009445212B2

(12) United States Patent
Chen et al.

(10) Patent No.: US 9,445,212 B2
(45) Date of Patent: Sep. 13, 2016

(54) MEMS MICROPHONE MODULE AND MANUFACTURING PROCESS THEREOF

(75) Inventors: Lung-Tai Chen, Fongshan (TW); Chun-Hsun Chu, Tainan (TW); Wood-Hi Cheng, Kaohsiung (TW)

(73) Assignee: Industrial Technology Research Institute (TW)

( * ) Notice: Subject to any disclaimer, the term of this patent is extended or adjusted under 35 U.S.C. 154(b) by 1965 days.

(21) Appl. No.: 12/050,368

(22) Filed: Mar. 18, 2008

(65) Prior Publication Data

US 2009/0129622 A1 May 21, 2009

(51) Int. Cl.
*H04R 9/08* (2006.01)
*H04R 31/00* (2006.01)
*H04R 19/01* (2006.01)

(52) U.S. Cl.
CPC ..... *H04R 31/00* (2013.01); *H04R 19/016* (2013.01)

(58) Field of Classification Search
USPC ..... 381/369
See application file for complete search history.

(56) References Cited

U.S. PATENT DOCUMENTS

2003/0007655 A1* 1/2003 Yun et al. ..... 381/170
2004/0057595 A1* 3/2004 Tanabe et al. ..... 381/396
2005/0185812 A1 8/2005 Minervini
2005/0207605 A1* 9/2005 Dehe et al. ..... 381/369
2008/0219482 A1* 9/2008 Sato ..... 381/174

FOREIGN PATENT DOCUMENTS

JP 2007174635 7/2007

OTHER PUBLICATIONS

Foreign Office Action for Application No. 096144199; dated Nov. 4, 2010; TIPO.

* cited by examiner

*Primary Examiner* — Matthew Gordon
(74) *Attorney, Agent, or Firm* — Stevens & Showalter, LLP

(57) ABSTRACT

A micro-electro-mechanical system (MEMS) microphone module and a manufacturing process thereof are described. A thickness of a transparent temporary cover plate temporarily disposed in a conventional plastic package structure is adjusted. After a mold for a plastic protector is formed, an UV ray is utilized to irradiate the mold to reduce adherence on the temporary cover plate and a back surface of the MEMS acoustic wave sensing chip. Then, the temporary cover plate is removed, and the left space left is the main source for the back-volume of the MEMS microphone. Finally, a tag is covered on the plastic protector, so as to define the whole back-volume and form a closed back-volume. In the above-mentioned process, the size of the back-volume is the same as an area of the whole MEMS microphone chip. In addition, the back-volume can be defined.

9 Claims, 9 Drawing Sheets

MEMS MICROPHONE MODULE AND MANUFACTURING PROCESS THEREOF

CROSS-REFERENCE TO RELATED APPLICATIONS

This non-provisional application claims priority under 35 U.S.C. §119(a) on Patent Application No(s). 096144199 filed in Taiwan, R.O.C. on Nov. 21, 2007, the entire contents of which are hereby incorporated by reference.

BACKGROUND OF THE INVENTION

1. Field of Invention

The present invention relates to a micro-electro-mechanical system (MEMS) microphone module and a manufacturing process thereof. More particularly, the present invention relates to an MEMS microphone module with an increased back volume and a manufacturing process thereof.

2. Related Art

For integrated circuit element products having microphones, a demand for MEMS microphones is increasing. Recent global mobile phone manufacturers provide an additional microphone for photographing function for practical convenience besides a microphone for communication. Recently, portable audio and digital camera products having micro hard disks or flash memories increasingly features this design so the MEMS microphones may have a considerable market share in the future.

As for the MEMS microphone with thin thickness and small volume, a surface adhesion process can be performed thereon through solder reflow, thereby effectively reducing assembling cost. Therefore, the MEMS microphones are increasingly occupying the original market of electric condenser microphones (ECMs) because of the small volume and low cost. Additionally, the MEMS microphone has an inherent advantage of low power consumption (160 μA), which is approximately ⅓ of that of the ECM. For the mobile phone application with limited power storing capacity, the advantage of power saving also distinctly promotes the MEMS microphone to replace the ECM.

Referring to FIGS. 1A to 1B, in US patent publication No. US 20050185812, a back volume 14 of a microphone package is defined by hollowing downward without penetrating a supporting substrate 11 at a position of the supporting substrate 11 corresponding to a central vibrating thin film 13 of an MEMS microphone chip 12. In addition, a printed circuit board and the supporting substrate are adhered with a hole 15 sandwiched therebetween, and the sandwiched hole 15 region overlaps the hollowed region of the supporting substrate 11, for serving as an extension of the back volume 14 to enlarge the back volume 14. For a common MEMS microphone module design, a size of the common MEMS microphone chip is approximately 2.0 by 2.0 mm, a diameter region of an acoustic wave vibration sensing thin film is approximately 1.0 mm, and the supporting substrate has a thickness of 0.2 to 0.3 mm, so a possible thickness of the sandwiched hollow is approximately 0.07 mm. Generally speaking, in practical compression bonding process of the supporting substrate, it is difficult to control the hollow thickness of the middle layer to be uniform, and the downward extending depth from the diameter region of the acoustic wave vibration sensing thin film is limited by the thickness of the supporting substrate, so the formed space is limited.

SUMMARY OF THE INVENTION

The present invention is directed to provide an MEMS microphone module, which includes a supporting substrate with an acoustic wave injection hole; an MEMS microphone chip with an acoustic wave sensing mechanism region fixed on the supporting substrate for serving as an acoustic wave sensing unit; a plastic body wrapping all elements on the supporting substrate except for an upper surface of the MEMS microphone chip and forming an external structural main body of the MEMS microphone module; and a tag adhered to an outer surface of the plastic body, so as to define a back volume.

In the present invention, the acoustic wave injection hole of the supporting substrate is a vertical through hole or a step through hole.

In the present invention, the tag further includes at least one through hole of round, polygon, or other irregular shape at a scope corresponding to the MEMS microphone chip under the tag.

In the present invention, the through hole of the tag is arranged in a radiating distribution of an array or staggered array or in a random distribution. A diameter or a long side diameter of a single through hole of the tag is smaller than or equal to a side length of the MEMS microphone chip. A single through hole of the tag can be placed at the geometric center of the scope corresponding to the MEMS microphone chip under the tag or at a random position.

The present invention is further directed to provide a manufacturing process of an MEMS microphone chip component, which includes providing an MEMS microphone wafer having a plurality of MEMS microphone chips and having a plurality of die cutting lines, an active surface, and a back surface; closely adhering a transparent temporary cover plate on the center of the back surface of the MEMS microphone wafer by using an UV adhesive; forming a plurality of grooves on a upper surface of the temporary cover plate corresponding to the die cutting lines; filling the grooves space with a sacrificial material; forming a plurality of sacrificial layers by using an exposing and developing process; and cutting the grooves to form a plurality of MEMS microphone chip components, such that the temporary cover plate of each MEMS microphone chip component forms a back volume cover plate, and a replacing layer formed by the sacrificial material is left around the back volume cover plate.

The present invention provides a manufacturing process of an MEMS microphone module, which includes providing a supporting substrate with a plurality of units of pads and a plurality of corresponding acoustic wave injection holes; fixing and electrically coupling the MEMS microphone chip component obtained from the abovementioned manufacturing process of the MEMS microphone chip component and an applied integrated circuit element on a supporting substrate; forming a plastic body in a package mole to wrap the integrated circuit element and surround the MEMS microphone chip component and a side surface of the back volume cover plate; removing the replacing layer around the back volume cover plate; removing the back volume cover plate to form a back volume space; bonding a tag on an outer surface of the plastic body, so as to form a closed back volume with the space in which the back volume cover plate is originally located; and cutting the supporting substrate and the plastic body to form a single MEMS microphone module.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Detailed description of the preferred embodiment of the present invention is given with the accompanying drawings as follows.

Figure 1A:
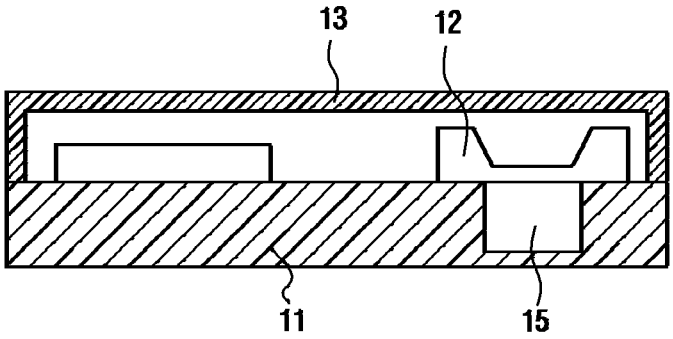
Fig.1A (Prior art)
FIGS. 1A to 1B are schematic views of an MEMS microphone module with an increased back volume in the conventional art.
Figure 1B:
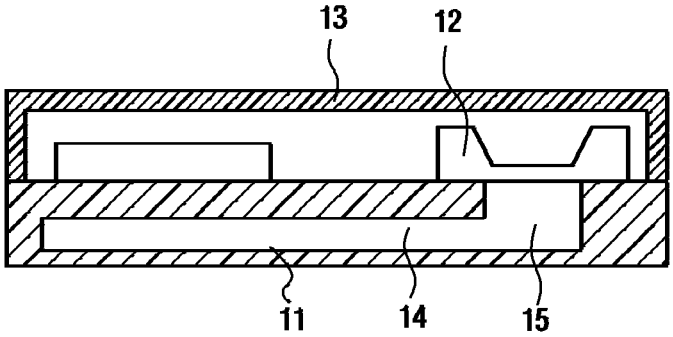
Fig.1B (Prior art)
Figure 2A:
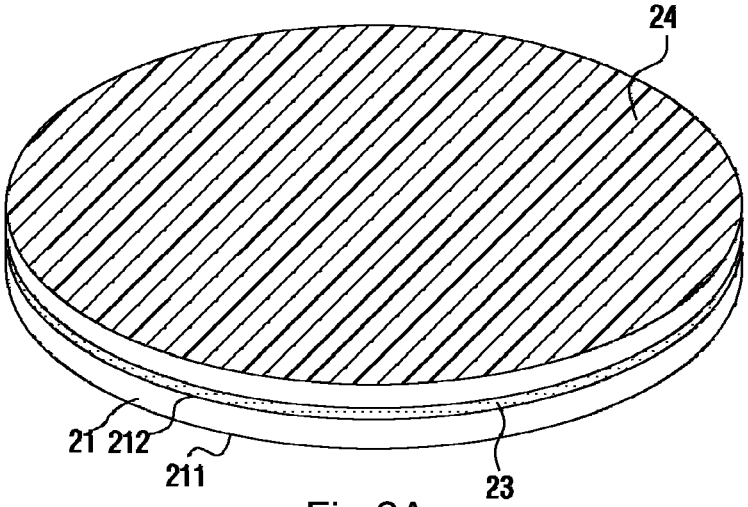
FIGS. 2A to 2E are schematic views of a structural flow of a manufacturing process of an MEMS microphone chip component according to an embodiment of the present invention.
Figure 2B:
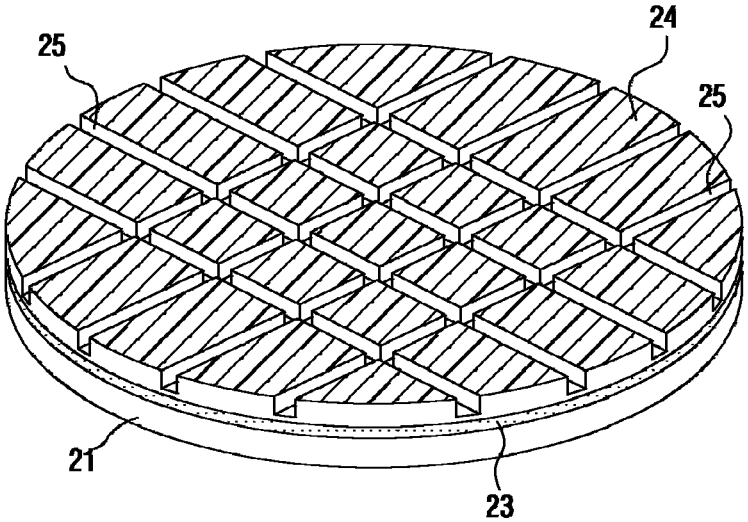
Figure 2C:
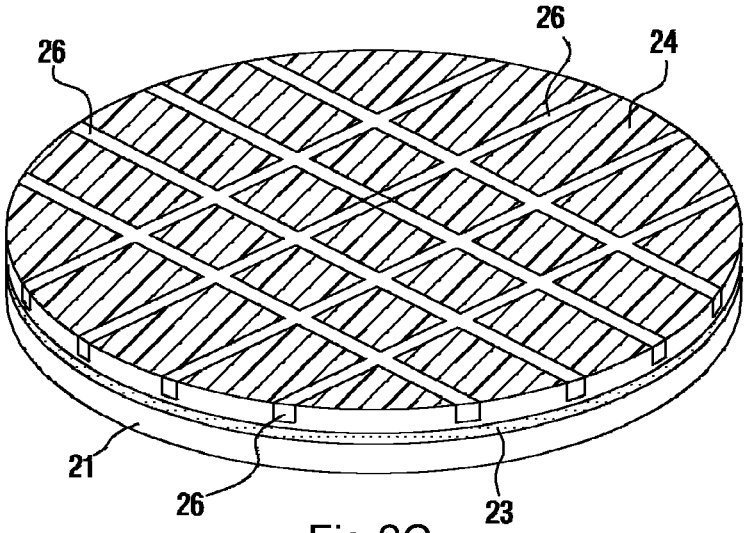
Figure 2D:
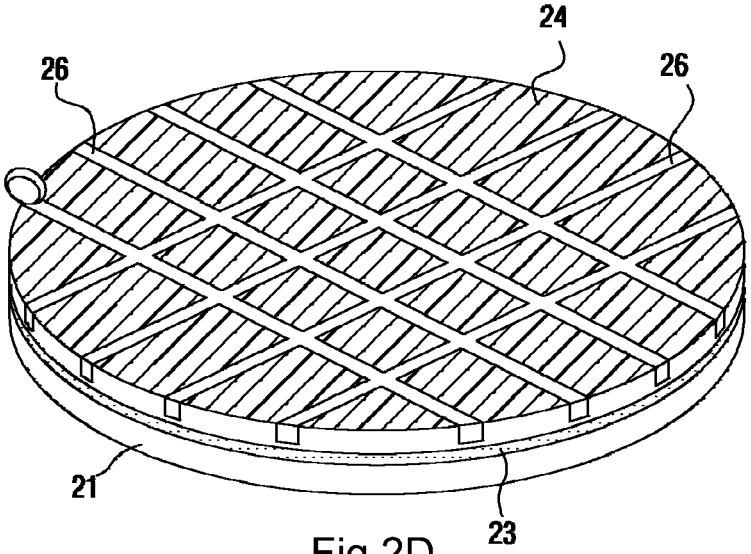
Figure 2E:
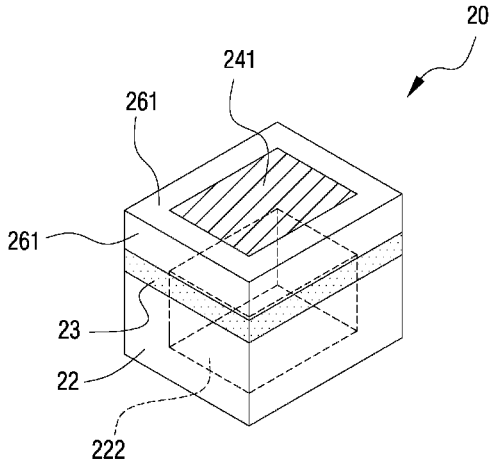
Figure 3A:
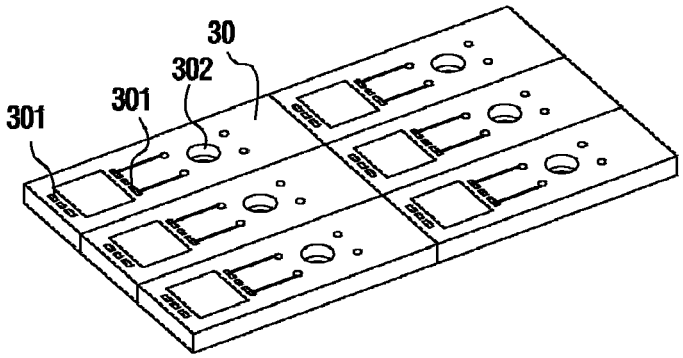
FIGS. 3A to 3F are schematic views of a structural flow of a manufacturing process of an MEMS microphone module according to an embodiment of the present invention.
Figure 3B:
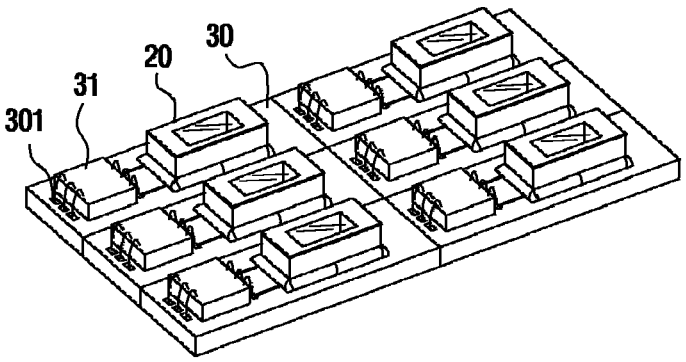
Figure 3C:
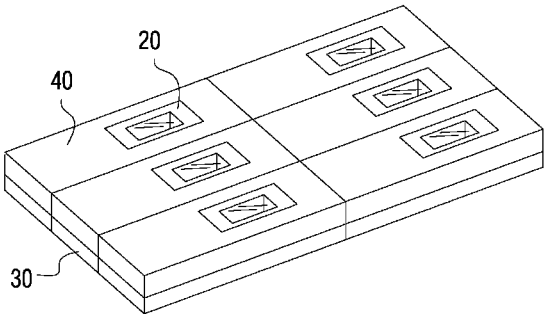
Figure 3D:
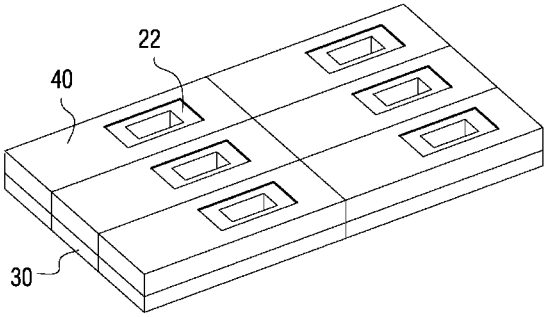
Figure 3E:
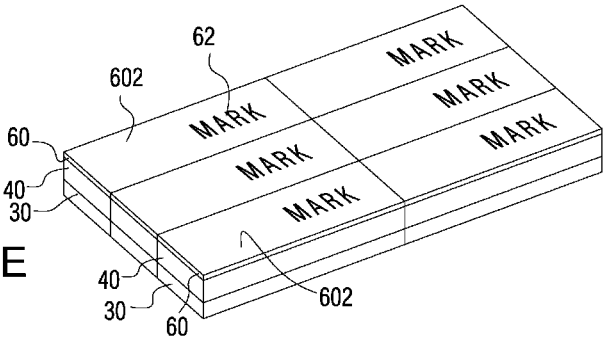
Figure 3F:
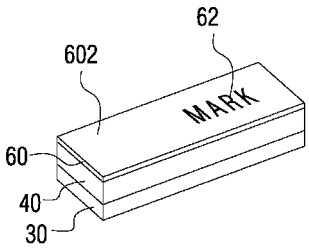

Referring to FIGS. 2A to 2E, schematic views of the structural flow of the manufacturing process of an MEMS microphone chip component according to an embodiment of the present invention are shown. The manufacturing process of an MEMS microphone chip component 20 includes providing an MEMS microphone wafer 21 having a plurality of MEMS microphone chips 22, an active surface 211 and a back surface 212; closely adhering a transparent temporary cover plate 24 on the center of the back surface 212 of the MEMS microphone wafer 21 by using an UV adhesive 23 (as shown in FIG. 2A); forming a plurality of grooves 25 on a upper surface of the temporary cover plate 24 corresponding to the periphery of each MEMS microphone chip (as shown in FIG. 2B); filling space of the grooves 25 with a sacrificial material 26 (as shown in FIG. 2C); forming the sacrificial material 26 into a plurality of sacrificial layers by using an exposing and developing process; and cutting the grooves 25 to form a plurality of MEMS microphone chip components 20 (as shown in FIGS. 2D and 2E), such that a replacing layer 261 formed by the sacrificial material 26 is left around a back volume cover plate 241 formed by the temporary cover plate 24 of each MEMS microphone chip component 20.

The MEMS microphone chip component 20 disclosed in FIG. 2E includes the MEMS microphone chip 22 having a chip upper surface 2201 and a chip lower surface 2202, in which the chip upper surface 2201 has an acoustic wave sensing portion of an acoustic wave sensing mechanism region 221, and the chip lower surface 2202 has a recess structure of a recess 222; and a mixed back volume cover plate component including the back volume cover plate 241 and the replacing layer 261, in which the replacing layer 261 surrounds the back volume cover plate 241, the mixed back volume cover plate component is combined with the chip lower surface 2202 of the MEMS microphone chip 22, and defines a closed space with the acoustic wave sensing portion of the acoustic wave sensing mechanism region 221 and the MEMS microphone chip 22.

Referring to FIGS. 3A to 3F, schematic views of the structural flow of a manufacturing process of an MEMS microphone module according to an embodiment of the present invention are shown. The process includes fixing the MEMS microphone chip component 20 on a supporting substrate 30 having a plurality of units of pads 301 and a plurality of corresponding acoustic wave injection holes 302, and fixing a matching integrated circuit element 31; electrically coupling the chip upper surface 2201 of the MEMS microphone chip component 20 and the integrated circuit element 31 on the supporting substrate 30, in which the electrically coupling method can be realized by flip-chip bonding or underfill 32 technique; forming a protective plastic body 40 in a package mold (not shown) to wrap the integrated circuit element 31 and surround the MEMS microphone chip component 20 and a side surface region of the back volume cover plate 241; removing the replacing layer 261 around the back volume cover plate 241 by using an etching process; using an UV ray for irradiation to reduce the adherence of the UV adhesive 23 adhering the temporary cover plate, so as to remove the back volume cover plate 241 to form a back volume 50 space; bonding a tag 60 on an outer surface of the plastic body 40, so as to form the closed back volume 50 with the space in which the back volume cover plate 241 is originally located; and cutting the supporting substrate 30 and the plastic body 40 to form a single MEMS microphone module 70.

In the embodiment, a tag note 62 is further formed on the upper surface of the tag 60 by using a laser, printing, etching, punching, stamping, or transferring process. Further, the lower surface of the tag 60 and the outer surface of the plastic body 40 are bonded by a process of heating and fusing adhesive or heating and curing adhesive. A material of the tag 60 is one selected from a group consisting of pure metal, pure nonmetal, and composite material.

In the above embodiment, the outer surface of the plastic body 40 can be higher than the chip lower surface 2202 of the MEMS microphone chip 22, and the plastic body 40 is formed by a method of integral resin transfer molding or damming/filling fluid dispensing.

Figure 4:
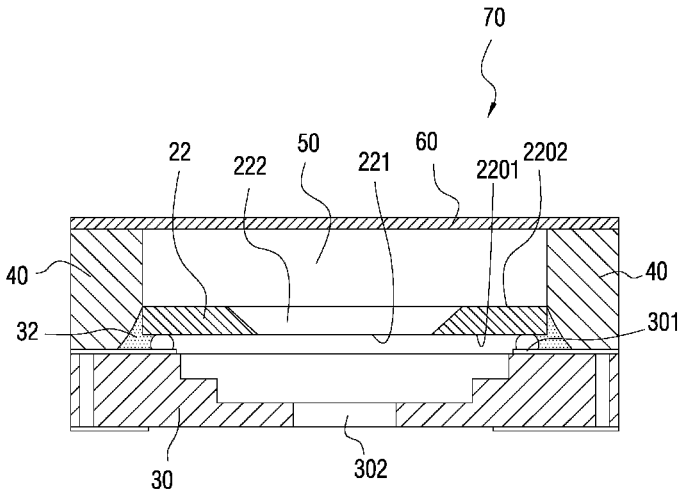
FIG. 4 is a cross-sectional view of the MEMS microphone module according to an embodiment of the present invention.

Referring to FIG. 4, a cross-sectional view of the MEMS microphone module according to an embodiment of the present invention is shown. The structure includes a supporting substrate 30 having the plurality of pads 301 and the acoustic wave injection hole 302, in which the acoustic wave injection hole 302 can be a vertical through hole or a step through hole; the MEMS microphone chip 22 bonded on the supporting substrate 30 by flip-chip bonding with the chip upper surface 2201 and then underfilling, in which the chip upper surface 2201 has the acoustic wave sensing mechanism region 221, the chip lower surface 2202 relative to another side of the sensing mechanism region 221 has the recess 222, and the recess 222 corresponds to the acoustic wave injection hole 302 for serving as an acoustic wave sensing unit; the plastic body 40 wrapping all elements (including the integrated circuit element 31) on the supporting substrate 30 except for the chip lower surface 2202 of the MEMS microphone chip 22, so as to form an external structural main body of the MEMS microphone module 70; and the tag 60 adhered to the outer surface of the plastic body 40 to define the back volume 50.

Figure 5:
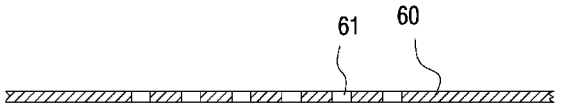
FIG. 5 is a cross-section view of the embodiment that the through hole is opened on the tag according to the embodiment of FIG. 4.

In the above embodiment, the tag 60 further has at least one through hole 61 at a scope corresponding to the MEMS microphone chip 22 under the tag (as shown in FIG. 5). The diameter or the long side diameter of the single through hole 61 of the tag 60 is smaller than or equal to a side length of the MEMS microphone chip 22. The through hole 61 can be of round, polygon, or other irregular shape, and can be arranged in a radiating distribution of an array or staggered array or in a random distribution.

Figure 6:
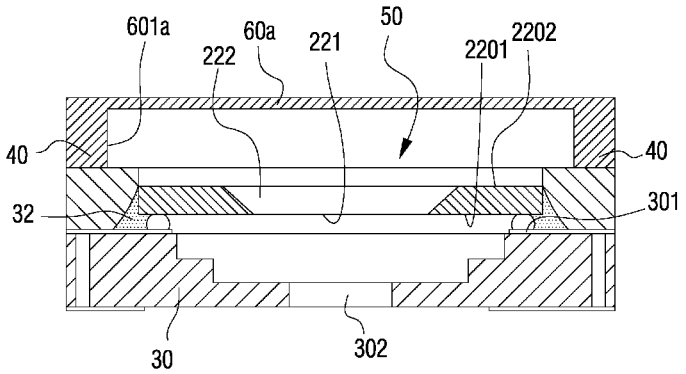
FIG. 6 is a cross-sectional view of an MEMS microphone module according to another embodiment of the present invention.

Referring to FIG. 6, as compared with the embodiment of FIG. 4, a tag 60*a* has a bottom hole 601*a*. When the tag 60*a* is adhered on the top surface of the plastic body 40, the bottom hole 601*a* corresponds to the position of the acoustic wave sensing mechanism region 221.

Figure 7:
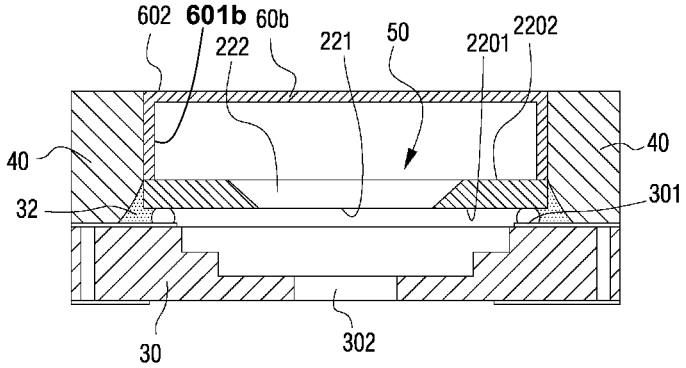
FIG. 7 is a cross-sectional view of an MEMS microphone module according to still another embodiment of the present invention.

Referring to FIG. 7, another embodiment of the MEMS microphone module is shown. The structure includes the supporting substrate 30 having a plurality of pads 301 and the acoustic wave injection hole 302; the MEMS microphone chip 22 fixed on the supporting substrate 30 by flip-chip bonding with the chip upper surface 2201 and then underfilling, in which the MEMS microphone chip 22 has the acoustic wave sensing mechanism region 221, and has the recess 222 relative to another side of the sensing mechanism region 221 for serving as an acoustic wave sensing unit; a tag 60*b* fixed on the chip lower surface 2202 of the MEMS microphone chip 22, in which the tag 60*b* has a bottom hole 601*b* right opposite to the acoustic wave sensing mechanism region 221; and the plastic body 40 wrapping all devices on the surface of the supporting substrate 30 and exposing the top surface 602 of the tag 60*b*.

What is claimed is:

1. A micro-electro-mechanical system (MEMS) microphone module, comprising:

a supporting substrate, having a plurality of pads and an acoustic wave injection hole;

an MEMS microphone chip, having a chip upper surface and a chip lower surface, wherein the chip upper surface is directly flip-chip bonded to the pads and has an acoustic wave sensing mechanism region, and the chip lower surface relative to the other side of the acoustic wave sensing mechanism region has a recess, so as to form an acoustic wave sensing unit;

a plastic body, enclosing all elements on the supporting substrate except for the chip lower surface of the MEMS microphone chip, and forming an external structural main body of the MEMS microphone module, wherein the pads are sandwiched between the supporting substrate and the plastic body, and opposite two inner side surfaces of the plastic body contact the MEMS microphone chip; and a tag, adhered to an outer surface of the plastic body, so as to define a back volume;

wherein the supporting substrate, the plastic body and the tag are three discrete parts.

2. The MEMS microphone module as claimed in claim 1, wherein the tag further has a bottom hole corresponding to the acoustic wave sensing mechanism region.

3. The MEMS microphone module as claimed in claim 1, wherein the tag further comprises at least one through hole at a scope corresponding to the MEMS microphone chip under the tag.

4. The MEMS microphone module as claimed in claim 3, wherein the through hole of the tag is of round, polygon, or other irregular shape.

5. The MEMS microphone module as claimed in claim 3, wherein arrangement of the through hole of the tag is of a radiating distribution in an array or staggered array or of a random distribution.

6. The MEMS microphone module as claimed in claim 3, wherein a diameter or a long side diameter of a single through hole of the tag is smaller than or equal to a side length of the MEMS microphone chip.

7. The MEMS microphone module as claimed in claim 3, wherein a single through hole of the tag is placed at the geometric center of the scope corresponding to the MEMS microphone chip under the tag.

8. The MEMS microphone module as claimed in claim 1, wherein the tag is spaced from the MEMS microphone chip with the back volume defined in the space between the tag and the MEMS microphone chip.

9. The MEMS microphone module as claimed in claim 1, wherein the pads are electronically coupled to the microphone chip.

* * * * *